US005333862A

United States Patent [19]

Teramoto et al.

[11] Patent Number: 5,333,862

[45] Date of Patent: Aug. 2, 1994

[54] WOOD TYPE GOLF CLUB

[75] Inventors: Mitsutake Teramoto; Shinkichi Saito; Hideyo Asabuki, all of Tokyo, Japan

[73] Assignee: The Yokohama Rubber Co., Ltd., Tokyo, Japan

[21] Appl. No.: 102,803

[22] Filed: Aug. 6, 1993

[30] Foreign Application Priority Data

Aug. 10, 1992 [JP] Japan ..... 4-56078[U]

[51] Int. Cl.[5] ..... A63B 53/04

[52] U.S. Cl. ..... 273/80 C; 273/167 G; 273/175

[58] Field of Search ..... 273/167 R, 77 A, 77 R, 273/164.1, 193 R, 194 R, 80 C

[56] References Cited

U.S. PATENT DOCUMENTS

| | | | |
|---|---|---|---|
| 959,053 | 5/1910 | Fonler | 273/80 C |
| 1,657,473 | 1/1928 | Howard | 273/175 X |
| 2,023,885 | 12/1935 | Hinckley | 273/175 X |
| 2,842,369 | 7/1958 | East | 273/164.1 |
| 2,934,347 | 4/1960 | Siniscalchi | 273/167 J |
| 3,625,518 | 12/1971 | Solheim | 273/175 |
| 4,157,830 | 6/1979 | Taylor | 273/167 G |
| 4,367,878 | 1/1983 | Schmidt | 273/175 |
| 5,098,103 | 3/1992 | Mackeil | 273/175 |

*Primary Examiner*—Vincent Millin
*Assistant Examiner*—Sebastiano Passaniti
*Attorney, Agent, or Firm*—Finnegan, Henderson, Farabow, Garrett & Dunner

[57] ABSTRACT

A wood type golf club having a club head provided with a sole at the bottom portion thereof, a ball striking face at the front side thereof and a hosel at the heel side thereof, and a club shaft joined to the hosel of the club head, characterized in that a face angle $\theta_1$ measured on the basis of a direction square with the direction in which a ball is to be driven thereby, toward the side of a closed face of the club head is set to 0°-5° closed face, a lie angle $\theta_2$ defined as an angle of inclination of the axis of the club shaft with respect to a horizontal line and measured with the sole of the club head contacting a horizontal ground surface being set to 58°-62°, an angle of center of gravity $\theta_3$ defined as an angle which is formed between an extension line of the face of the club head and a straight line crossing the axis of the club shaft at right angles thereto when the club shaft is placed on a horizontal table so that the club head is directed downward therefrom freely, viewing from the side of the sole along the axis of the club shaft being set to 27°-33°.

5 Claims, 2 Drawing Sheets

WOOD TYPE GOLF CLUB

BACKGROUND OF THE INVENTION

This invention relates to a wood type golf club, and more particularly to a wood type golf club which is suitable especially for beginners or golfers having a low head speed, and which is capable of restraining the occurrence of the curving of a driven ball to the right of a right-handed player, i.e. the occurrence of a so-called slice.

Since a wood type golf club is used generally for the purpose of obtaining a longer flying distance of a ball, the volume of a head thereof is larger than that of a head of an iron golf club, and the length of a shaft of the former golf club also larger than that of a shaft of the latter golf club. Therefore, when, especially, for example, a right-handed beginner or a right-handed golfer having a low head speed addresses or strikes a ball with a wood type golf club, the face of the golf club is opened outward, so that a driven ball curves to the right of the player, i.e., a so-called slice tends to occur frequently.

With a view to eliminating these inconveniences, an improved wood type golf club has been proposed in which a face angle of the club head measured on the basis of a direction square with the direction in which a ball is to be driven thereby, a lie angle, i.e. an angle of inclination of the club shaft measured with the whole surface of the sole of the club head contacting the ground surface, and an angle of center of gravity which is defined as an angle formed between an extension line of the face of the club head and a straight line passing the axis of the club shaft at right angles thereto, and which is measured with the club shaft placed on a horizontal table so that the club head is directed downward therefrom freely are regulated independently of one another. The face angle, lie angle and angle of center of gravity generally adopted of a wood type Golf club produced so as to eliminate the occurrence of a slice mentioned above are 0°-2° toward the side of a closed face, 55°-58° and 18°-23° respectively. However, such a conventional slice-preventing wood type golf club is designed mainly for advanced and intermediate class golfers, and, when a beginner or a golfer having a low head speed drives a ball with this golf club, a slice still tends to occur.

SUMMARY OF THE INVENTION

An object of the present invention is to provide a wood type golf club capable of restraining the occurrence of a slice, i.e. the rightward curving of a ball driven by a right-handed player with the golf club.

Another object of the present invention is to provide a wood type golf club which reduces a tendency of causing, especially, a beginner and a golfer having a low head speed to have a slice.

A wood type golf club which achieves these objects of the present invention has a club head provided with a sole at the bottom portion thereof, a ball striking face at the front side thereof and a hosel at the heel side thereof, and a club shaft joined to the hosel of the club head, and is characterized in that a face angle $\theta_1$ measured on the basis of a direction square with the direction in which a ball is to be driven thereby, toward the side of a closed face of the club head, a lie angle $\theta_2$ defined as an angle of inclination of the axis of the club shaft with respect to a horizontal line and measured with the sole of the club head contacting a horizontal ground surface, and an angle of center of gravity $\theta_3$ defined as an angle which is formed between an extension line of the face of the club head and a straight line crossing the axis of the club shaft at right angles thereto when the club shaft is placed on a horizontal table so that the club head is directed downward therefrom freely, viewing from the side of the sole at right angles to the axis of the club shaft are set to:

$0° \leqq \theta_1 \leqq 5°$ $58° \leqq \theta_2 \leqq 62°$ $27° \leqq \theta_3 \leqq 33°$ Since the face angle, lie angle and angle of center of gravity of the wood type golf club are set in this manner relatively to one another so that all of them satisfy these formulae, it becomes possible that even a beginner of golf and a golfer having a low head speed reduce a trend of the occurrence of the curving of a driven ball to the right of the players in case of the right-handed. A wood type golf club, in which, especially, a hosel and a club shaft are joined together with a crank type connecting member, having a combination of such angles enables this slice-reducing effect to be displayed remarkably.

BRIEF DESCRIPTION OF THE DRAWINGS

FIGS. 3 and 4 are diagrams illustrating an angle of center of gravity of the wood type golf club according to the present invention, wherein FIG. 3 illustrates a club shaft placed on a horizontal table with a club head suspended downward therefrom freely; and FIG. 4 is a view taken in the direction of an arrow A in FIG. 3.

DESCRIPTION OF THE PREFERRED EMBODIMENT

Figure 1:
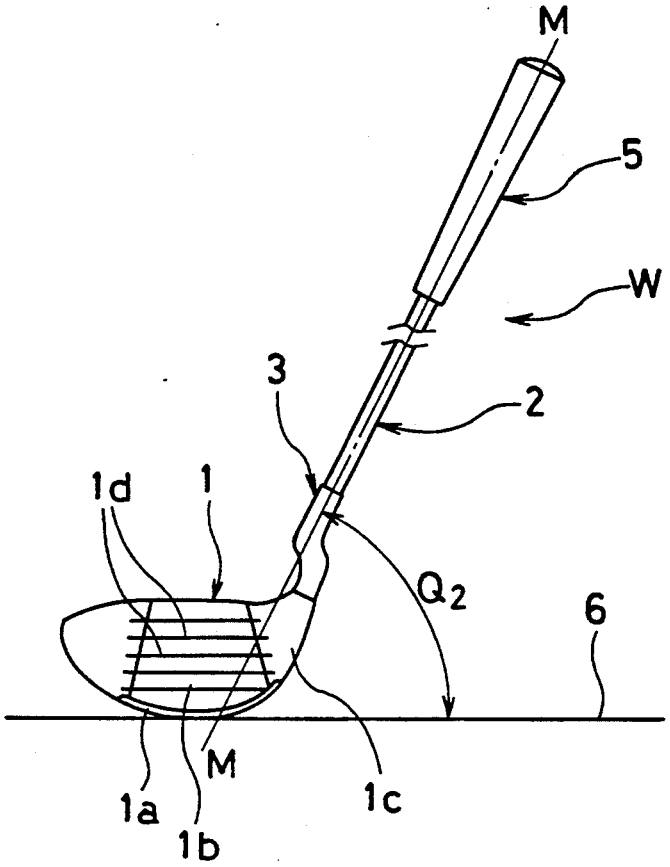
FIG. 1 is a front elevation of the wood type golf club according to the present invention with a part of the club shaft omitted.

In a wood type golf club W shown in FIG. 1, a reference numeral 1 denotes a club head, and 2 a club shaft. The club head 1 has a sole 1*a* at the bottom portion thereof, a ball striking face 1*b* at the front side thereof, and a hosel 1*c* at the heel side thereof. A reference numeral 1*d* denotes score lines consisting of grooves formed in the face 1*b*. A crank-like bent connecting member 3 is fixed to the hosel 1*c* of the club head 1, and one end of the club shaft 2 is joined firmly to the club head 1 via this connecting member 3. A reference numeral 5 denotes a grip fitted around the other end portion of the club shaft 2.

Figure 2:
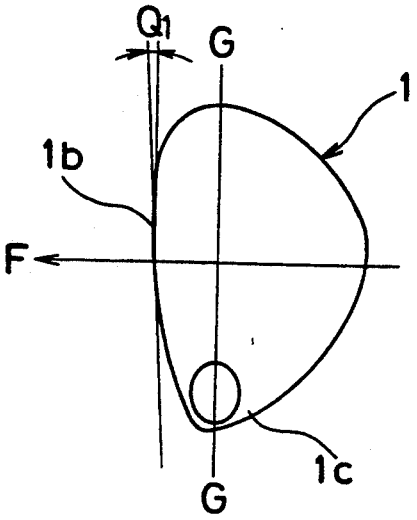
FIG. 2 is a diagram illustrating a face angle $\theta_1$ of the wood type golf club according to the present invention.
Figure 3:
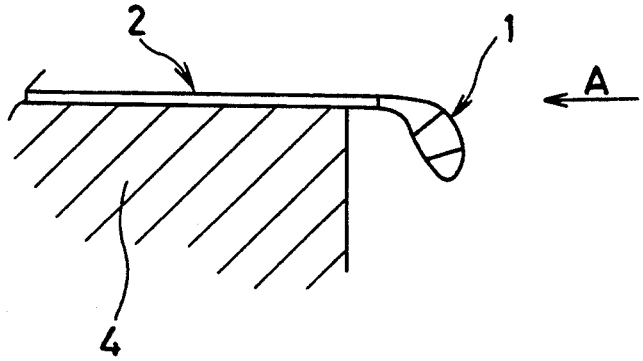
Figure 4:
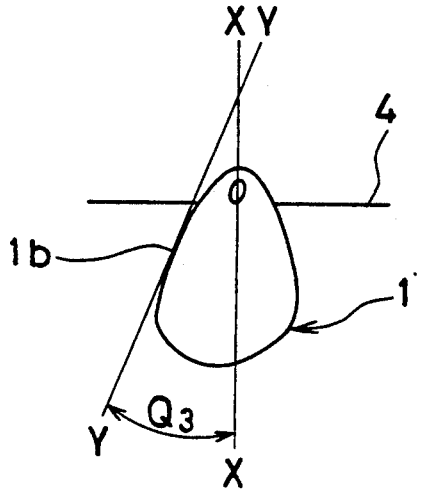

In the wood type golf club according to the present invention formed as described above, a face angle of the club head measured on the basis of a direction square with the direction in which a ball is to be driven, i.e. a face angle $\theta_1$ defined as an angle of inclination of the face 1*b* with respect to a line G—G, which crosses at right angles an intended line of flight F, as shown in FIG. 2 is set to 0°-5° toward a closed face. A lie angle $\theta_2$ defined as an angle between the axis M—M of the club shaft 2 and a horizontal surface 6 and measured with the sole 1*a* of the club head 1 contacting the horizontal surface 6 as shown in FIG. 1 is set to 58°-62°. An angle of center of gravity $\theta_3$ defined as an angle which is formed between an extension line Y—Y of the face 1*b* of the club head 1 and a straight line X—X crossing the axis of the club shaft 2 at right angles thereto when the club shaft 2 is placed on a horizontal table 4 with the club head 1 projected outward therefrom and directed downward freely, viewing from the side of the sole along the axis of the club shaft, i.e., in the direction of an arrow A as shown in FIGS. 3 and 4 is set to 27°-33°.

When the face angle $\theta_1$ is over 0° open face, or when the lie angle $\theta_2$ is smaller than 58°, or when the angle of center of gravity $\theta_3$ is smaller than 27°, a driven ball becomes liable to fly out to the right of a right-handed golfer, and the tendency of the occurrence of a slice cannot be down satisfactorily. When the face angle $\theta_1$ is larger than 5° closed face, or when the lie angle $\theta_2$ is larger than 62°, or when the angle of center of gravity $\theta_3$ is larger than 33°, a driven ball becomes liable to fly out to the left of a right-handed golfer, i.e., a hook tends to occur.

Thus, according to the present invention, by setting the face angle $\theta_1$ of the club head 1, lie angle $\theta_2$ and angle of center of gravity $\theta_3$ of the wood type golf club W interdependently and systematically, the occurence of a slice can be restrained. In case of right-handed golfer, the occurence of the curving of a driven ball to the right can be going down and in case of left-handed golfer, the occurence of the curving of a driven ball to the left can be getting down. Especially, a beginner of the golf and a golfer having a low head speed can reduce the frequency in the occurrence of a slice.

Figure 5:
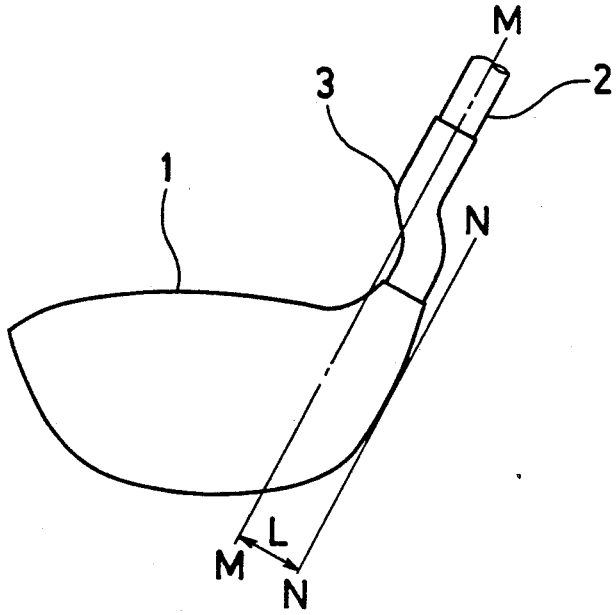
FIG. 5 is a diagram showing a distance L between a heel side end of the club head of the wood type golf club according to the present invention and the axis of the club shaft thereof.

Regarding the setting of the face angle, lie angle and angle of center of gravity, the crank-shaped connecting member 3 is preferably offset at its club shaft-side portion to the side of a toe of the club head along an extending direction of the face 1*b*. A distance by which the club shaft-side portion of the connecting member 3 is offset, i.e. a distance L shown in FIG. 5 between the axis M—M of the club shaft 2 and a tangential line N—N drawn in parallel with this axis so as to pass a heel side end of the club head 1 may be set within 16 mm. More preferably, it may be set to 12-16 mm. This enables a position of fixing the club shaft 2 to the club head 1 to be set closer to the center of gravity of the club head 1, and the club head to meet a ball easily. Consequently, a slice restraining effect can be achieved further and the directional stability of a driven ball can be improved moreover.

The present invention will now be described more concretely.

A wood type golf club (Present Example) according to the present invention consisting of the structure of FIG. 1 and a conventional wood type golf club (Conventional Example) having no connecting member were made with the angles $\theta_1$, $\theta_2$, $\theta_3$ and distance L set as shown in Table 1. These golf clubs were tested by three golfers under the following conditions, and the results of determination of the rates of occurrence of slice are shown in Table 2.

1. Golfers' career:
   (a) Beginner A: Less than 1 year's experience, 50 years old (male), head speed of 37 m/sec.
   (b) Beginner B: Less than 2 years' experience, 35 years old (male), head speed of 43 m/sec.
   (c) Intermediate-class golfer C: Less than 5 years' experience, 40 years old (male), head speed of 40 m/sec.
2. Method of testing:

Each golfer struck balls 20 times by using the golf clubs according to the present invention and the conventional golf club. The balls were hit at random in predetermined order on the basis of a randamized number table in consideration of golfers' familiarization to the golf clubs and the physical fatigue, which influence the resultant data.

3. Method of determining the rate of occurrence of slice:

A target was placed in a position directly opposite to and 50 m away from a ball to be driven, and a ball driven toward the target and went spinning off therefrom by not less than 30° to the right of a right-handed golfer was judged to be a slice. The rate of occurrence of slice was calculated as a percentage. The number of hooked balls was out of the count.

TABLE 1

| Item | Face angle $\theta_1$ | Lie angle $\theta_2$ | Angle of center of gravity $\theta_3$ | L |
|---|---|---|---|---|
| Present Example | 2.0° | 6.0° | 31° | 14.0 mm |
| Conventional Example | −1.0° | 57° | 25° | 12.0 mm |

TABLE 2

| | Rate of Slice | |
|---|---|---|
| | Present Example | Conventional Example |
| Beginner A | 70% | 83% |
| Beginner B | 48% | 78% |
| Intermediate class golfer C | 37% | 45% |

As is clear from Table 2, it can be said that the rate of occurrence of slice of the wood type golf club according to the present invention is certainly improved over that of the conventional wood type golf club without exception. Especially, the rate of occurrence of slice of the beginner B with less than 2 years' experience was improved by 30%, and even the rate of occurrence of slice of the beginner A having less than 1 year's experience and a head speed of 37 m/sec by 13%. Accordingly, it is understood that the wood type golf club according to the present invention enables, especially, a beginner and a golfer having a low head speed to greatly reduce the frequency in the occurrence of slice.

According to the present invention described above, in which the face angle $\theta_1$ of the club head, lie angle $\theta_2$ and angle of center of gravity $\theta_3$ are set to $0° \leqq \theta_1 \leqq 5°$ toward the closed face, $58° \leqq \theta_2 \leqq 62°$ and $27° \leqq \theta_3 \leqq 33°$ respectively in relation with one another, can restrain the curving of a driven ball to the right of a right-handed golfer, i.e. the occurrence of slice. This wood type golf club is used very effectively, especially, by a beginner and a golfer having a low head speed.

What is claimed is:

1. A wood type golf club comprising a club head provided with a sole at a bottom portion thereof, a ball striking face at a front side thereof and a hosel at a heel side thereof, and a club shaft joined to said hoset of said club head, characterized in that a face angle $\theta_1$ measured on the basis of a direction square with the direction in which a ball is to be driven by said face, toward the side of a closed face of said club head is set to 0°–5° closed face, a lie angle $\theta_2$ defined as an angle of inclination of the axis of said club shaft with respect to a horizontal line and measured with said sole of said club head contacting a horizontal ground surface being set to 58°–62°, an angle of center of gravity $\theta_3$ defined as an angle which is formed between an extension line of said face of said club head and a straight line crossing the axis of said club shaft at right angles to the axis of said shaft when said club shaft is placed on a horizontal plane with said club head being is directed freely downward from said plane and viewed from said sole along the axis of said club shaft being set to 27°–33°.

2. A wood type golf club according to claim 1, wherein a crank-shaped connecting member is provided between said hosel of said club head and said club shaft.

3. A wood type golf club according to claim 2, wherein a joint portion which is connected to said club shaft of said crank-shaped connecting member is offset toward a toe side of said club head.

4. A wood type golf club according to claim 3, wherein a distance L between the axis of said club shaft and a tangential line drawn in parallel with said axis so as to pass a heel side end of said club head is not more than 16 mm.

5. A wood type golf club according to claim 4, wherein said distance L is 12–16 mm.

* * * * *

UNITED STATES PATENT AND TRADEMARK OFFICE

CERTIFICATE OF CORRECTION

PATENT NO. : 5,333,862
DATED : August 2, 1994
INVENTOR(S) : Mitsutake Teramoto et al.

It is certified that error appears in the above-indentified patent and that said Letters Patent is hereby corrected as shown below:

Claim 1, column 4, last line, change "hoset" to --hosel--; and column 5, last line, after "club head" insert --in the heel-to-toe direction-- and after "being" delete "is".

Signed and Sealed this

Twenty-seventh Day of December, 1994

*Attest:*

Bruce Lehman

BRUCE LEHMAN

*Attesting Officer*

*Commissioner of Patents and Trademarks*